US007784116B2

(12) United States Patent
Gallo et al.

(10) Patent No.: US 7,784,116 B2
(45) Date of Patent: Aug. 31, 2010

(54) PADDED GARMENT

(75) Inventors: Christopher Gallo, Plymouth, MA (US); Paul E. Litchfield, Westboro, MA (US); William McInnis, Westwood, MA (US); Francis V. Millette, Middleboro, MA (US)

(73) Assignee: Reebok International Ltd., Canton, MA (US)

( * ) Notice: Subject to any disclaimer, the term of this patent is extended or adjusted under 35 U.S.C. 154(b) by 74 days.

(21) Appl. No.: 11/460,306

(22) Filed: Jul. 27, 2006

(65) Prior Publication Data

US 2008/0022431 A1 Jan. 31, 2008

(51) Int. Cl.
*A41D 27/26* (2006.01)
*G21F 3/00* (2006.01)

(52) U.S. Cl. ..... 2/267; 2/455

(58) Field of Classification Search ..... 2/455, 2/456, 463–465, 467, 267, 268, 247, 250, 2/24, 67, 237; 36/89
See application file for complete search history.

(56) References Cited

U.S. PATENT DOCUMENTS 1,514,468 A * 11/1924 Schopf ..... 36/153
2,028,060 A * 1/1936 Gilbert ..... 47/32.5
2,123,447 A * 7/1938 Waite ..... 2/48
2,247,961 A * 7/1941 Mulvey ..... 2/462
2,249,966 A * 7/1941 Matthews ..... 2/464
2,501,640 A * 3/1950 Woodward ..... 2/268
2,657,385 A * 11/1953 Cushman et al. ..... 2/24
3,008,214 A * 11/1961 Foster et al. ..... 428/12
3,134,995 A * 6/1964 Kirchner ..... 441/117
3,186,004 A * 6/1965 Carlini ..... 2/413
3,945,042 A * 3/1976 Lobo ..... 2/467
3,995,320 A * 12/1976 Zafuto ..... 2/463
3,999,220 A 12/1976 Keltner
4,168,063 A * 9/1979 Rowland ..... 473/62
4,183,156 A 1/1980 Rudy
4,195,362 A 4/1980 Rolando
4,219,945 A 9/1980 Rudy
4,271,606 A 6/1981 Rudy
4,324,012 A * 4/1982 Cannaday ..... 5/656
4,471,538 A * 9/1984 Pomeranz et al. ..... 36/28
4,481,679 A * 11/1984 Hayes ..... 2/463
4,602,384 A * 7/1986 Schneider ..... 441/103

(Continued)

FOREIGN PATENT DOCUMENTS

EP 351147 A1 * 1/1990

*Primary Examiner*—Alissa L Hoey
(74) *Attorney, Agent, or Firm*—Sterne, Kessler, Goldstein & Fox P.L.L.C.

(57) ABSTRACT

A padded garment having at least one pocket with at least one pad located within the at least one pocket. The at least one pad has a plurality of interconnected, spaced apart tubes. A first end of each of the spaced apart tubes are interconnected along a first pathway and a second end of each of the spaced apart tubes are interconnected along a second pathway. The first and second pathways are recessed from a top plane and a bottom plane of the pad in areas between adjacent tubes such that the pad is flexible along the recessed areas of the first and second pathways and substantially less flexible along a length of the spaced apart tubes. The pad is shaped to correspond to an area of a wearer's body it is intended to cover.

24 Claims, 15 Drawing Sheets

U.S. PATENT DOCUMENTS 4,688,269 A * 8/1987 Maeshima ..... 2/456
4,703,750 A * 11/1987 Sebastian et al. ..... 602/13
4,768,295 A * 9/1988 Ito ..... 36/28
4,870,706 A * 10/1989 Ketcham et al. ..... 2/461
4,881,529 A * 11/1989 Santos ..... 2/468
4,884,295 A * 12/1989 Cox ..... 2/467
4,912,861 A * 4/1990 Huang ..... 36/29
4,914,836 A * 4/1990 Horovitz ..... 36/28
4,936,029 A * 6/1990 Rudy ..... 36/29
4,977,626 A * 12/1990 Smith ..... 2/250
5,005,300 A 4/1991 Diaz et al.
5,014,354 A * 5/1991 Dumont ..... 2/23
5,023,128 A * 6/1991 Fatool ..... 428/172
5,042,176 A 8/1991 Rudy
5,086,514 A * 2/1992 Ross ..... 2/467
5,152,082 A * 10/1992 Culpepper ..... 36/89
5,157,789 A * 10/1992 Klass ..... 2/114
5,161,257 A 11/1992 Arensdorf et al.
5,189,738 A * 3/1993 Mitchell ..... 2/268
5,275,315 A * 1/1994 Carmack et al. ..... 224/576
5,303,425 A * 4/1994 Mele ..... 2/115
5,329,640 A * 7/1994 Hourigan ..... 2/239
5,337,418 A * 8/1994 Kato et al. ..... 2/456
5,347,656 A * 9/1994 Fabritz et al. ..... 2/67
D351,056 S * 10/1994 Auger et al. ..... D2/961
5,365,610 A 11/1994 Lubahn et al.
5,372,575 A * 12/1994 Sebastian ..... 602/20
5,388,271 A * 2/1995 Sessoms ..... 2/115
5,410,755 A * 5/1995 Obujen ..... 2/465
5,423,087 A * 6/1995 Krent et al. ..... 2/463
5,450,858 A * 9/1995 Zablotsky et al. ..... 128/876
5,477,558 A * 12/1995 Volker et al. ..... 2/461
5,497,511 A * 3/1996 Zade ..... 2/22
5,551,082 A 9/1996 Stewart et al.
5,599,290 A * 2/1997 Hayes et al. ..... 602/61
5,636,377 A * 6/1997 Wiener ..... 2/465
5,689,836 A 11/1997 Fee et al.
5,862,531 A 1/1999 Ross
5,896,683 A * 4/1999 Foxen et al. ..... 36/89
5,918,310 A * 7/1999 Farahany ..... 2/23
6,128,837 A * 10/2000 Huang ..... 36/54
6,220,492 B1 * 4/2001 Huang ..... 224/264
6,260,201 B1 * 7/2001 Rankin ..... 2/69
6,282,729 B1 * 9/2001 Oikawa et al. ..... 2/465
6,295,654 B1 * 10/2001 Farrell ..... 2/456
6,393,618 B2 * 5/2002 Garneau ..... 2/228
6,408,446 B1 6/2002 Carrington
6,428,865 B1 8/2002 Huang
6,565,702 B1 * 5/2003 Forsyth et al. ..... 156/308.4
6,666,360 B1 * 12/2003 Swank ..... 224/148.2
6,687,917 B2 * 2/2004 Forsyth et al. ..... 2/228
6,715,218 B2 * 4/2004 Johnson ..... 36/89
6,796,865 B2 * 9/2004 Raithel et al. ..... 441/106
6,820,783 B2 * 11/2004 Beale ..... 224/644
6,859,948 B2 3/2005 Melts
6,883,253 B2 * 4/2005 Smith et al. ..... 36/28
6,910,229 B2 * 6/2005 Raithel et al. ..... 2/456
6,928,665 B1 * 8/2005 Yates ..... 2/466
6,968,637 B1 * 11/2005 Johnson ..... 36/88
7,010,823 B2 * 3/2006 Baek ..... 12/142 P
7,017,195 B2 * 3/2006 Buckman et al. ..... 2/455
7,412,731 B1 * 8/2008 Brassill ..... 2/456
7,448,522 B2 * 11/2008 Collier et al. ..... 224/264
2003/0150136 A1 * 8/2003 Johnson ..... 36/89
2005/0081277 A1 * 4/2005 Matechen et al. ..... 2/102
2005/0098590 A1 * 5/2005 Collier et al. ..... 224/264

* cited by examiner

PADDED GARMENT

BACKGROUND OF THE INVENTION

1. Field of the Invention

This invention relates to padded garments for athletes possessing flexible pads.

2. Background Art

Padded garments worn by athletes and sport enthusiasts typically include some form of padding to prevent injury to the athlete's body including the ribs, lower back, hips or coccyx. Such injuries can result from a multitude of athletic activities including football, hockey, field hockey, lacrosse, baseball, basketball, cycling or in-line skating.

Known forms of padding for athletic apparel, include closed cell foam, gel-filled cavities, and inflatable cushions filled with pressurized fluid. These forms of padding are relatively inflexible and are not shaped to bend to the contour of the athlete's body and can hinder free movement.

The padding can be attached directly to the inside or outside of the garment or can be located within pockets. Typically the padding is fixedly attached to the garment when not located within a pocket through stitching or adhesive. When the padding is located within a pocket, it is known to fixedly attach the padding to the pocket through stitching or other means in order to prevent it from falling out. However, this prevents the easy removal of the padding when laundering the garment.

There exists a need in the art for padding that is shaped to be more flexible so it can bend to the contour of the athlete's body and so it does not restrict free movement of the athlete's body. In addition, there is a need for pads which, in combination with increased flexibility, are easily removable from the garment to facilitate laundering the garment.

To that end, the present invention is directed to a garment with pads, wherein each pad comprises a plurality of interconnected, spaced apart tubes. The pads are flexible and can bend to the contour of an athlete's body.

BRIEF SUMMARY OF THE INVENTION

A garment of the present invention comprises an article of clothing having at least one pocket with at least one pad located within the at least one pocket. The at least one pad has a plurality of interconnected, spaced apart tubes.

A first end of each of the spaced apart tubes are interconnected along a first pathway and a second end of each of the spaced apart tubes are interconnected along a second pathway. The first and second pathways are recessed from a top plane and a bottom plane of the pad in areas between adjacent tubes such that the pad is flexible along the recessed areas of the first and second pathways and substantially less flexible along a length of the spaced apart tubes. The pad is flexible such that it conforms to an area of a wearer's body it is intended to cover and is shaped to correspond to an area of a wearer's body it is intended to cover.

In one embodiment, the interconnected, spaced apart tubes form a cavity, which is filled with fluid, such as air, that can flow between said plurality of spaced apart tubes. In an alternate embodiment the pads are made from gel or foam.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

The garment of the present invention comprises an article of clothing with protective pads. The article of clothing can be, but is not limited to, for example, a long sleeve shirt, a short sleeve shirt, a sleeveless shirt, a pair of shorts, or a pair of pants. The padded garment can be worn as an undergarment or as an outermost layer. The pads can be positioned to protect areas of the body prone to injury including, but not limited to, the ribs, shoulders, lower back, elbows, sternum, hips, coccyx, knees, or shins. The padded garments are envisioned for use in sports, including but not limited to, football, rugby, hockey, field hockey, lacrosse, baseball, basketball, field hockey, cycling, ice skating, roller skating or in-line skating. In addition, the padded garments can serve as everyday clothing for the elderly to prevent injury to areas such as the hips in the case of a fall.

Preferred embodiments of the present invention are now described. While specific configurations and arrangements are discussed, it should be understood that this is done for illustrative purposes only. A person skilled in the relevant art will recognize that other configurations and arrangements can be used without departing from the spirit and scope of the invention. It will also be apparent to a person skilled in the relevant art that this invention can be employed in a variety of other devices and applications.

Figure 1:
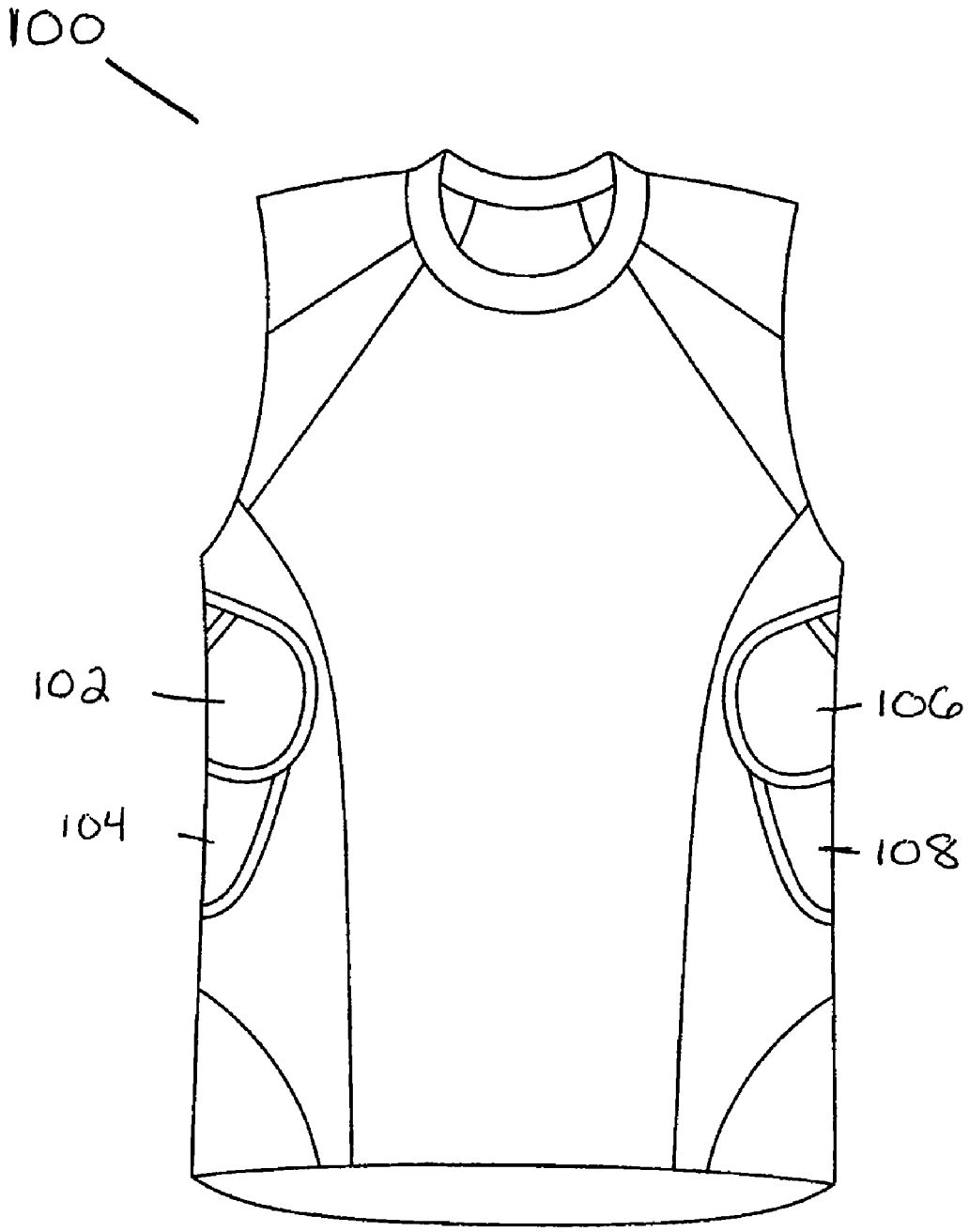
FIG. 1 is a front view of a sleeveless shirt having pockets for incorporating a pad.

FIG. 1 depicts a front view of a first embodiment of a padded garment in the form of a sleeveless shirt 100. It is noted that all references to right side and left side are made from the wearer's perspective. The sleeveless shirt 100 preferably has an upper right rib pocket 102, a lower right rib pocket 104, an upper left rib pocket 106 and a lower left rib pocket 108 for holding pads for protecting the right and left ribs. It is noted that pockets are a preferred means for holding pads against the garment, but other means for holding may be utilized as would be readily apparent to one of ordinary skill in the art, such as sewing or stitching, adhesive, clasps or hook and pile connectors. It is also noted that different holding means can be utilized for holding different pads to the same garment.

Figure 2:
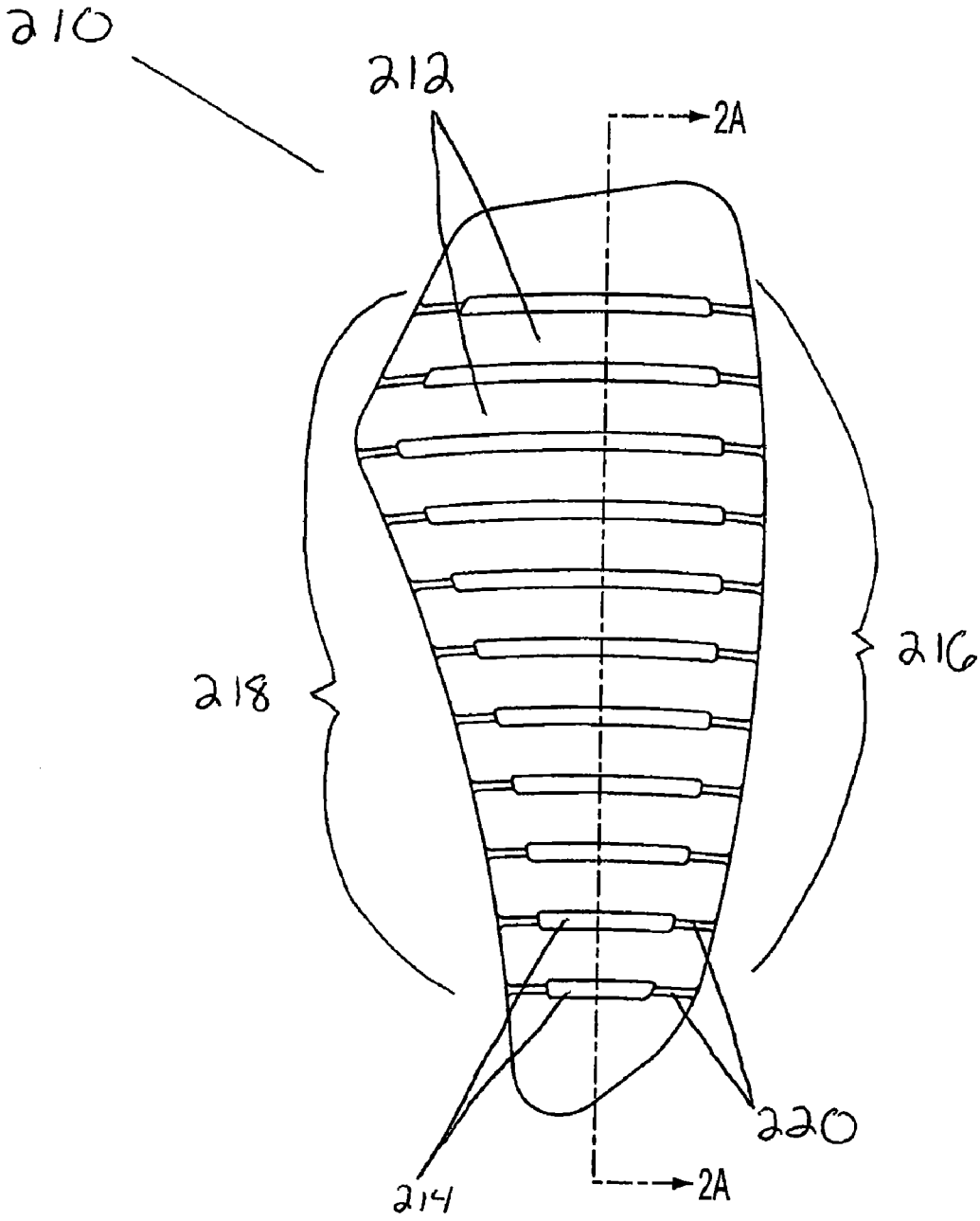
FIG. 2 is a top view of a pad shaped according to a first embodiment of the present invention.
Figure 2A:
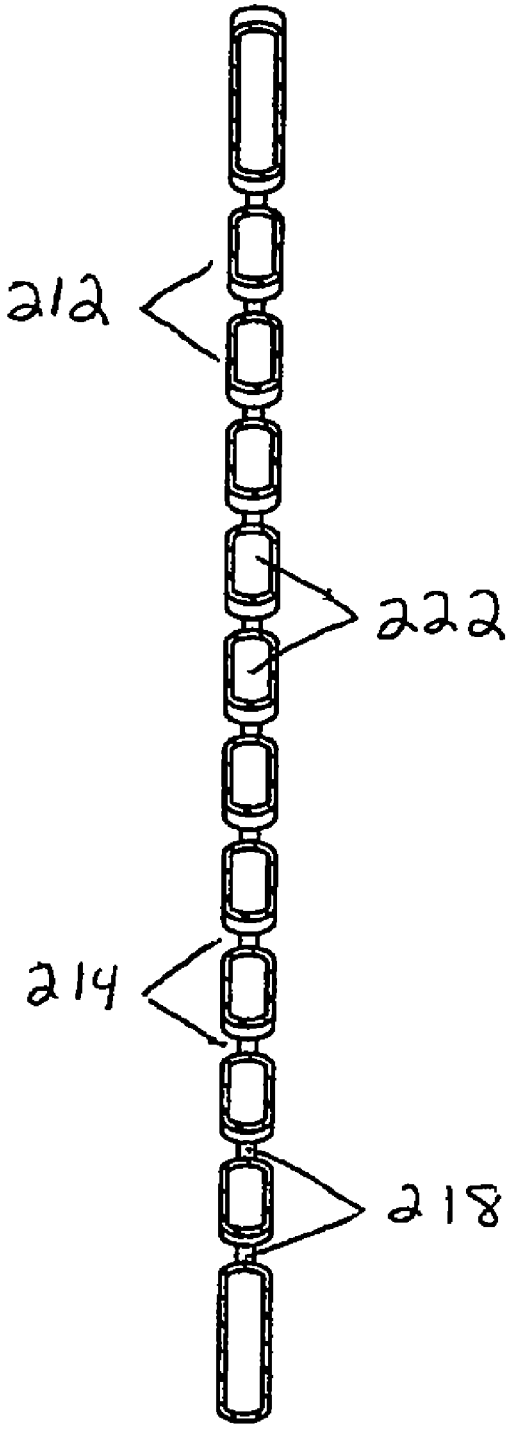
FIG. 2A is a cross-sectional view of the pad illustrated in FIG. 2.
Figure 3:
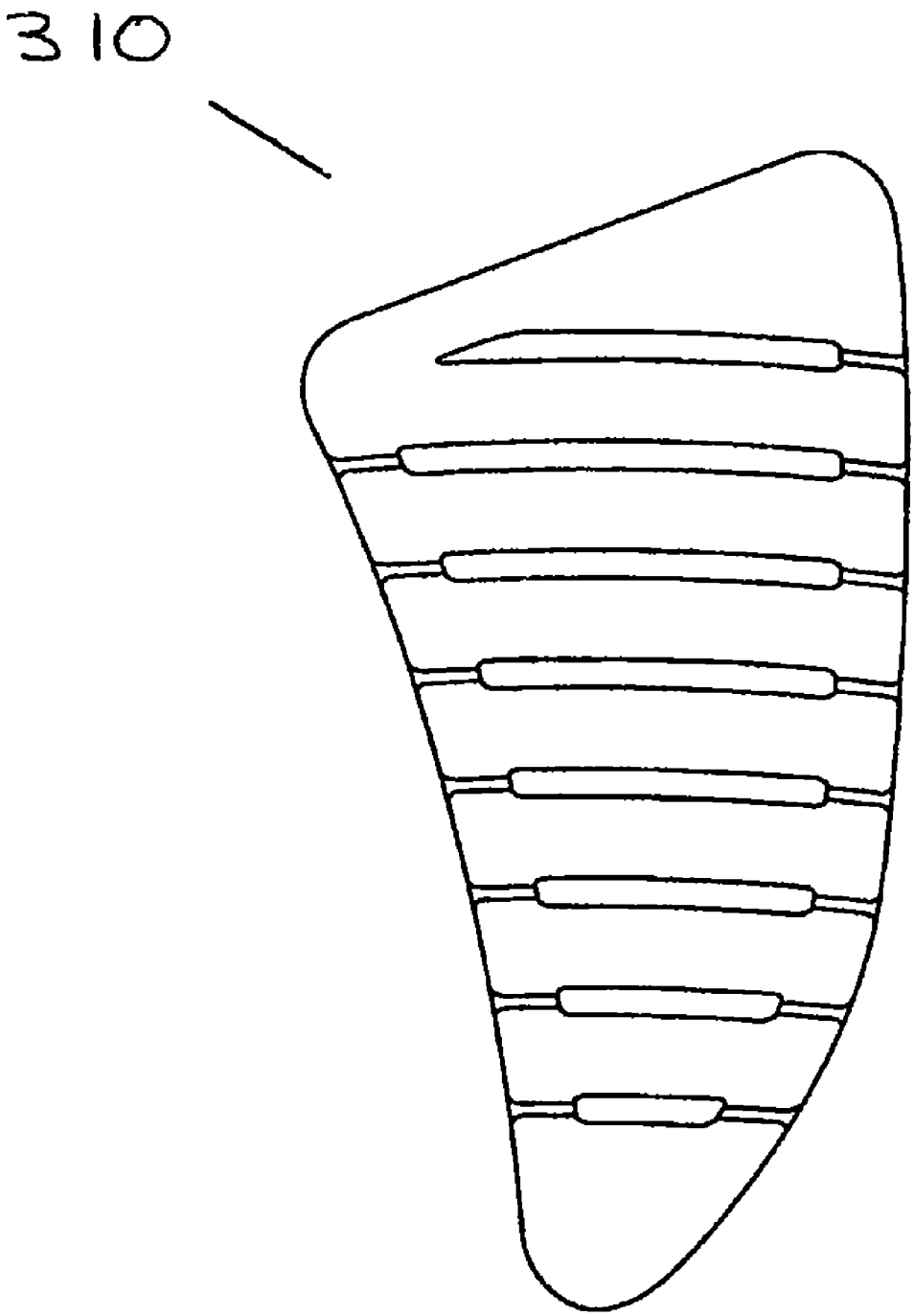
FIG. 3 is a top view of a pad shaped according to a second embodiment of the present invention.
Figure 4:
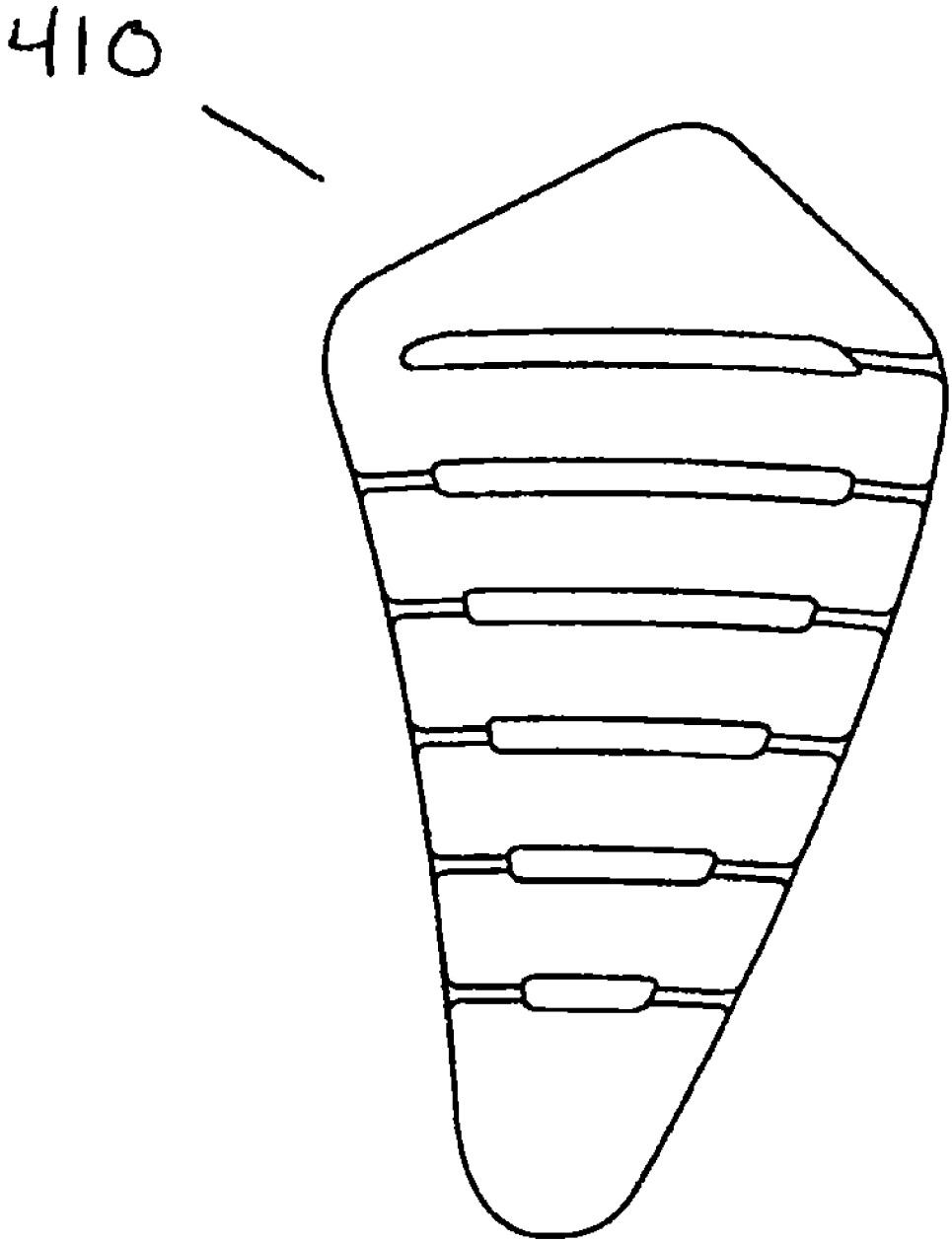
FIG. 4 is a top view of a pad shaped according to a third embodiment of the present invention.
Figure 5:
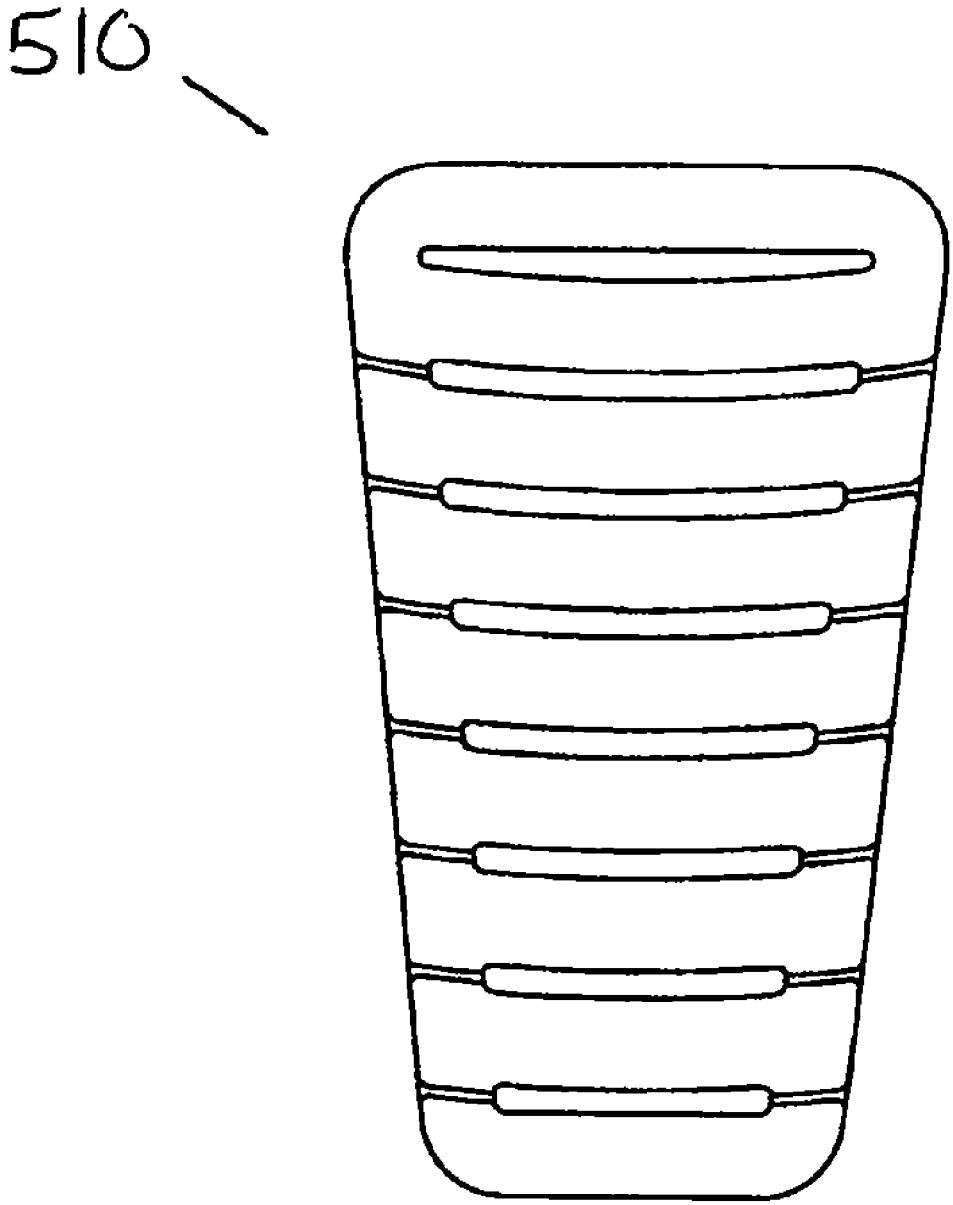
FIG. 5 is a top view of a pad shaped according to a fourth embodiment of the present invention.

FIGS. 2-5 depict pads 210, 310, 410 and 510, each with a different preferred shape. It is noted that these shapes are merely exemplary and are shaped to correspond to an area of a wearer's body the pad is intended to protect. Other shapes may be utilized as would be readily apparent to one of ordinary skill in the art. The pads of the present invention comprise a plurality of spaced apart tubes 212. The tubes 212 are aligned adjacent to each other along their lengths with gaps 214 in between adjacent tubes 212. Each tube 212 has a first end and a second end. The first ends of the tubes 212 are interconnected along a first pathway 216 and the second ends of the tubes 212 are interconnected along a second pathway 218. The first and second pathways 216, 218 are recessed from a top plane and a bottom plane of the pad, thereby providing recessed areas 220 between adjacent tubes 212. As shown in FIGS. 2 and 2A, gaps 214 may be apertures formed through the pads of the present invention defined by adjacent tubes 212, first pathway 216, and/or second pathway 218.

In a preferred embodiment, the interconnected tubes form a cavity 222 within the pad as shown in FIG. 2A, which depicts the cross-sectional view of pad 210 taken along line A-A in FIG. 2. The cavity 222 allows a fluid to flow between the interconnected tubes 212. Preferably, the cavity 222 is filled with air at atmospheric pressure, although it can also be filled with pressurized air or other fluid. Air flow between the interconnected tubes 222 is important as when the pad is impacted or receives a blow of force, the pad acts as a shock-absorbing cushion as air is able to flow from the point of impact and minimizes injury to the wearer of the pad and to the implement of force.

The pads comprise a polymeric material that is flexible and bendable and that allows for the pad to conform to an area of a wearer's body that the pad is intended to cover. Ethylene-vinyl acetate (EVA) is the preferred polymeric material, however other polymeric materials may be utilized as would have been apparent to one of ordinary skill in the art. The polymeric material may be formed into the shape of the pad utilizing conventional techniques.

In an alternative embodiment, the pads are made from a flexible and resilient material such as foam or gel. The flexible, resilient foam or gel pads have the same shape and characteristics of the pads described above with respect to FIGS. 2-5, except the pads are solid foam or gel and do not possess cavities filled with a fluid. The foam or gel is flexible and bendable and allows for the pad to conform to an area of a wearer's body that the pad is intended to cover. A pad of this embodiment also acts as a shock-absorbing cushion because when the pad is impacted or receives a blow of force, the foam or gel is deformable and is able to move from the point of impact and minimizes injury to the wearer of the pad and to the implement of force. Once the implement of force is removed the pad is able to return to its original shape due to the resiliency of the foam or gel.

Figure 6:
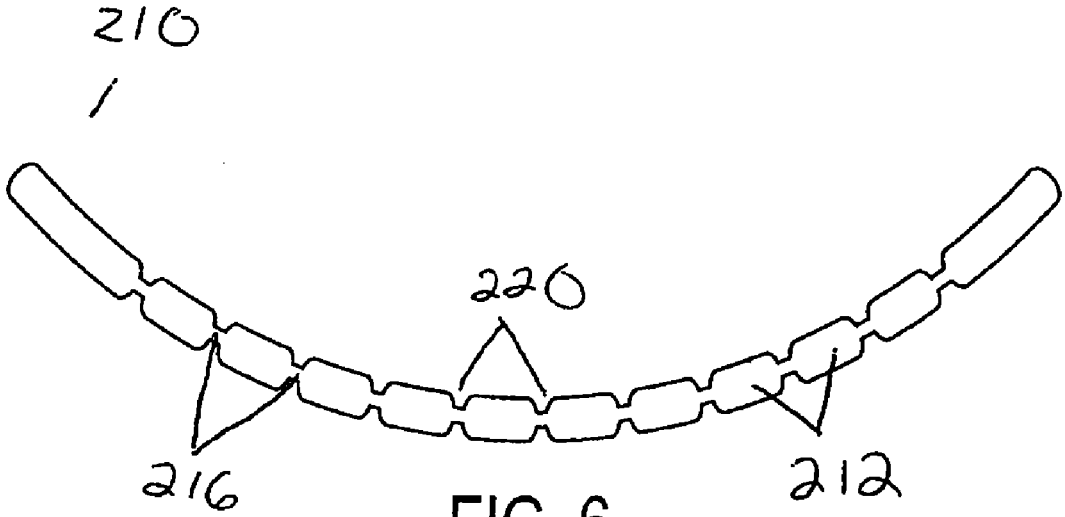
FIG. 6 is a side view of the pad illustrated in FIG. 2 while bent.
Figure 7:
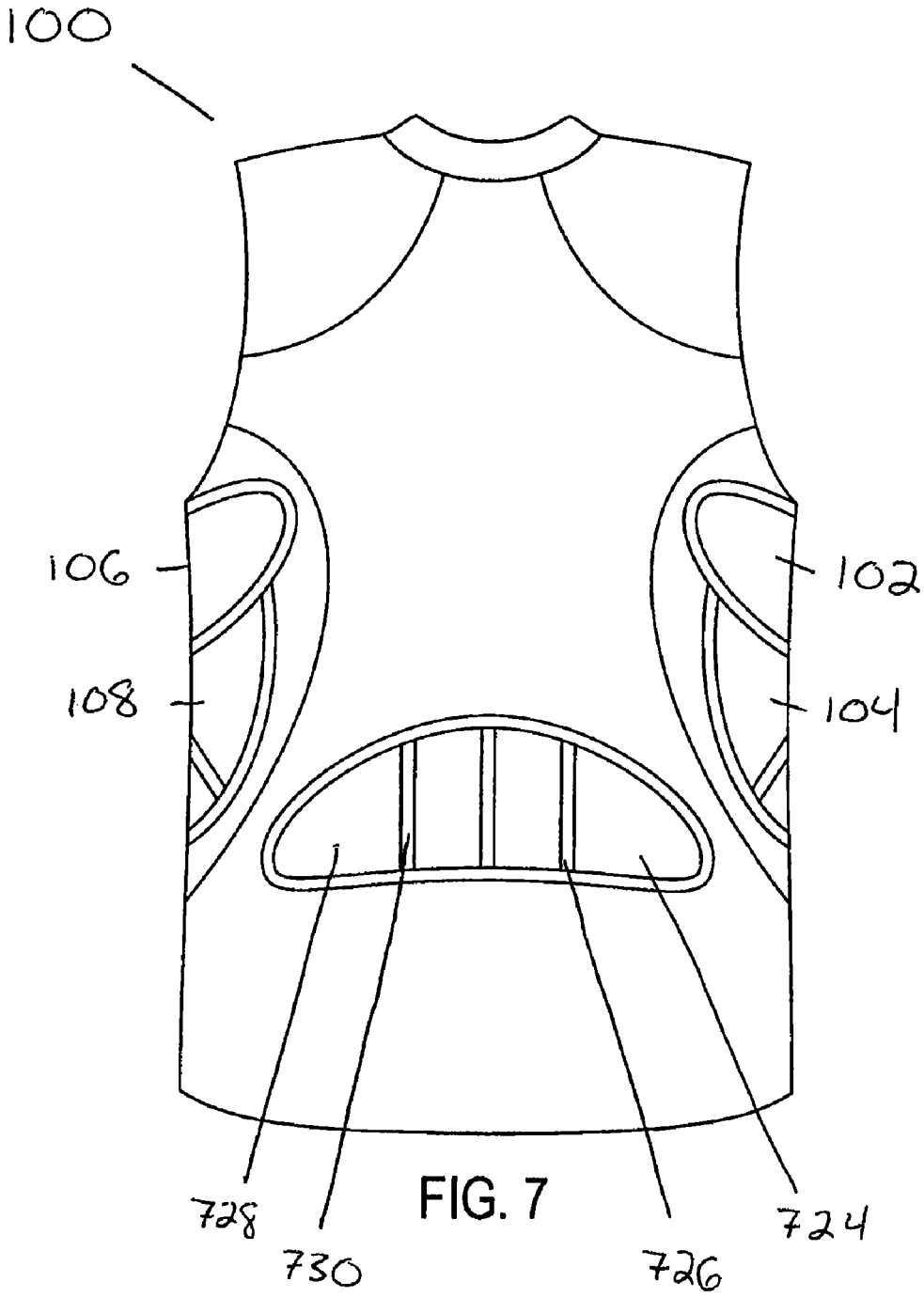
FIG. 7 is a back view of a sleeveless shirt having pockets for incorporating a pad.

The pads of all embodiments are flexible along said recessed areas 220 of said first and second pathways as shown in FIG. 6. The pads are substantially less flexible along a length of any of said plurality of spaced apart tubes. This feature facilitates the pads ability to conform to an area of a wearer's body that the pad is intended to protect, makes the padded garments more comfortable to wear and prevents the pads from restricting the movement of the wearer. The recessed areas 220 and gaps 214 also allow for increased breathability of the garment.

FIGS. 1 and 7-9 depict a first embodiment of the padded garment in the form of a sleeveless shirt 100. The sleeveless shirt 100 preferably has an upper right rib pocket 102, a lower right rib pocket 104, an upper left rib pocket 106, a lower left rib pocket 108, a right back pocket 724 and a left back pocket 728. Each pocket has an opening, 832, 834, 940, 942, 726 and 730, respectively, for insertion and removal of a pad from each pocket. The upper right and lower right rib pockets 102, 104 are located on a right side of the sleeveless shirt 100 and each contains a pad for protecting the right rib cage. The upper left and lower left rib pockets 106, 108 are located on a left side of the sleeveless shirt 100 and each contains a pad for protecting the left rib cage. The right and left back pockets 724, 728 are located on either side of a center of a back of the sleeveless shirt 100 and each contains a pad for protecting the lower back.

Figure 8:
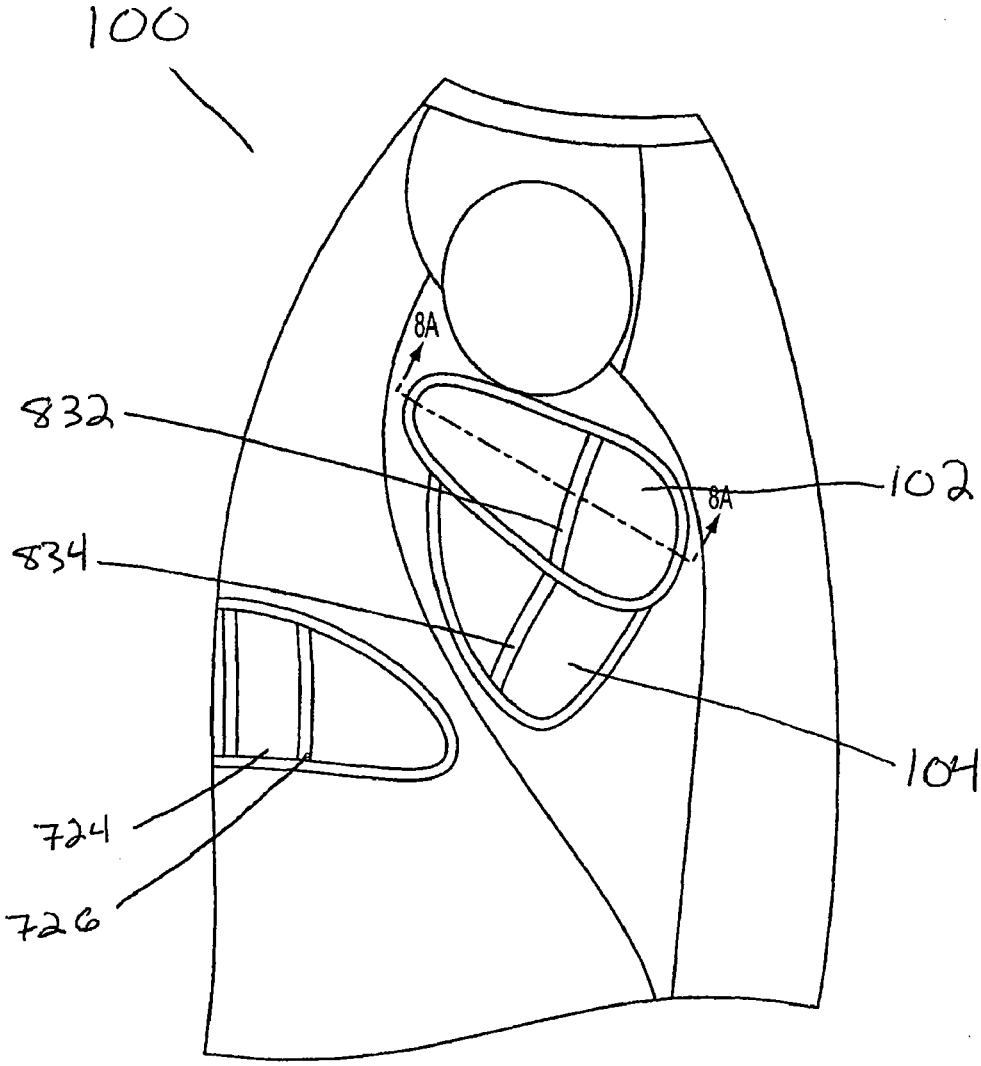
FIG. 8 is a right side view of a sleeveless shirt having pockets for incorporating a pad.
Figure 8A:
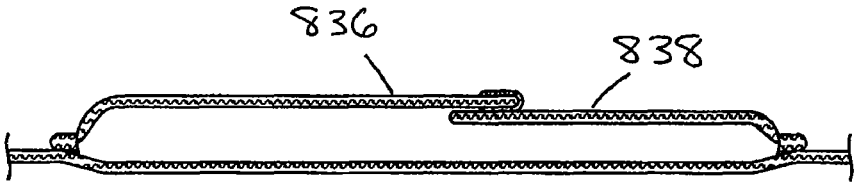
FIG. 8A is a cross-sectional view of a pocket illustrated in FIG. 8.
Figure 9:
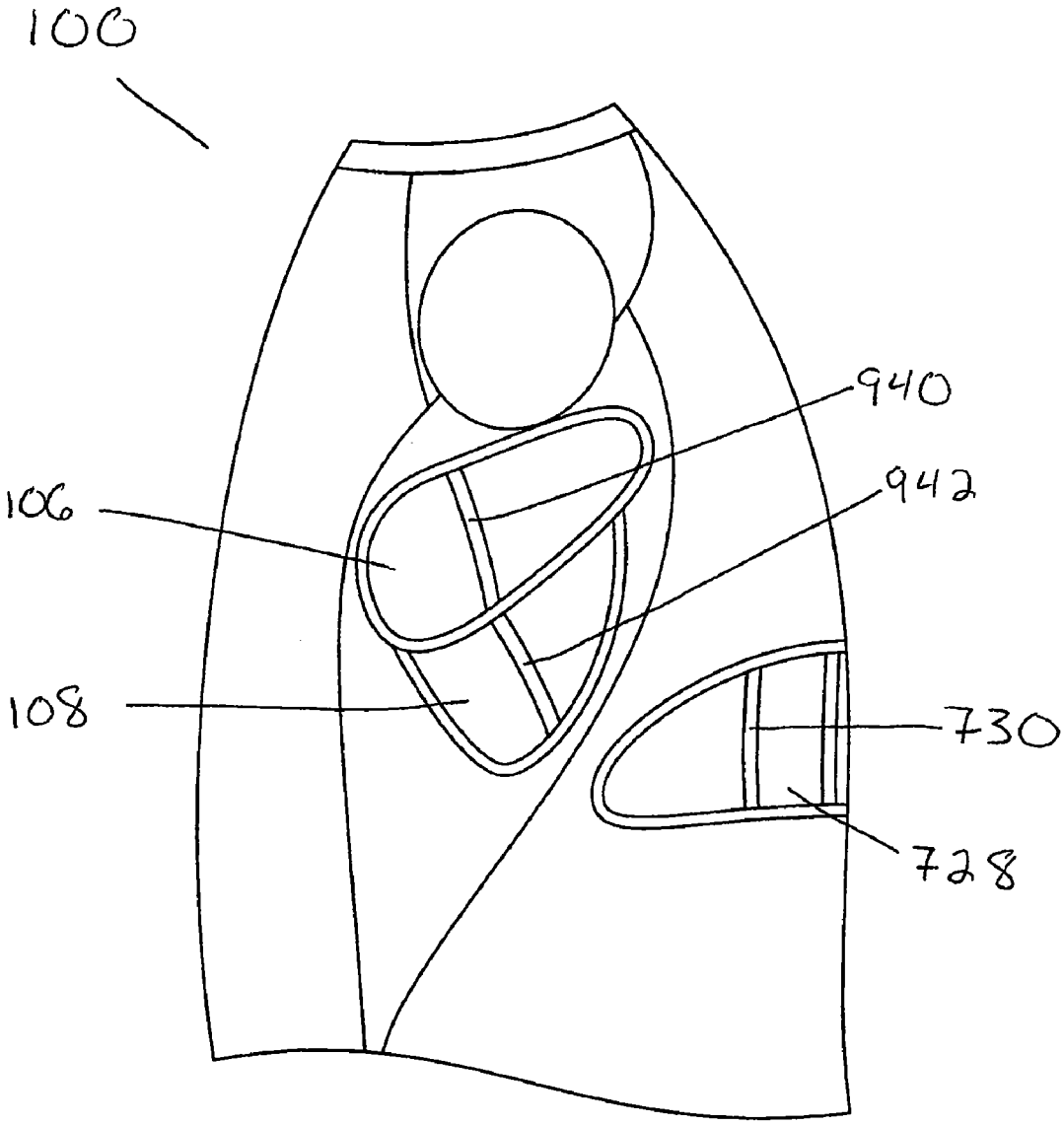
FIG. 9 is a left side view of a sleeveless shirt having pockets for incorporating a pad.
Figure 10:
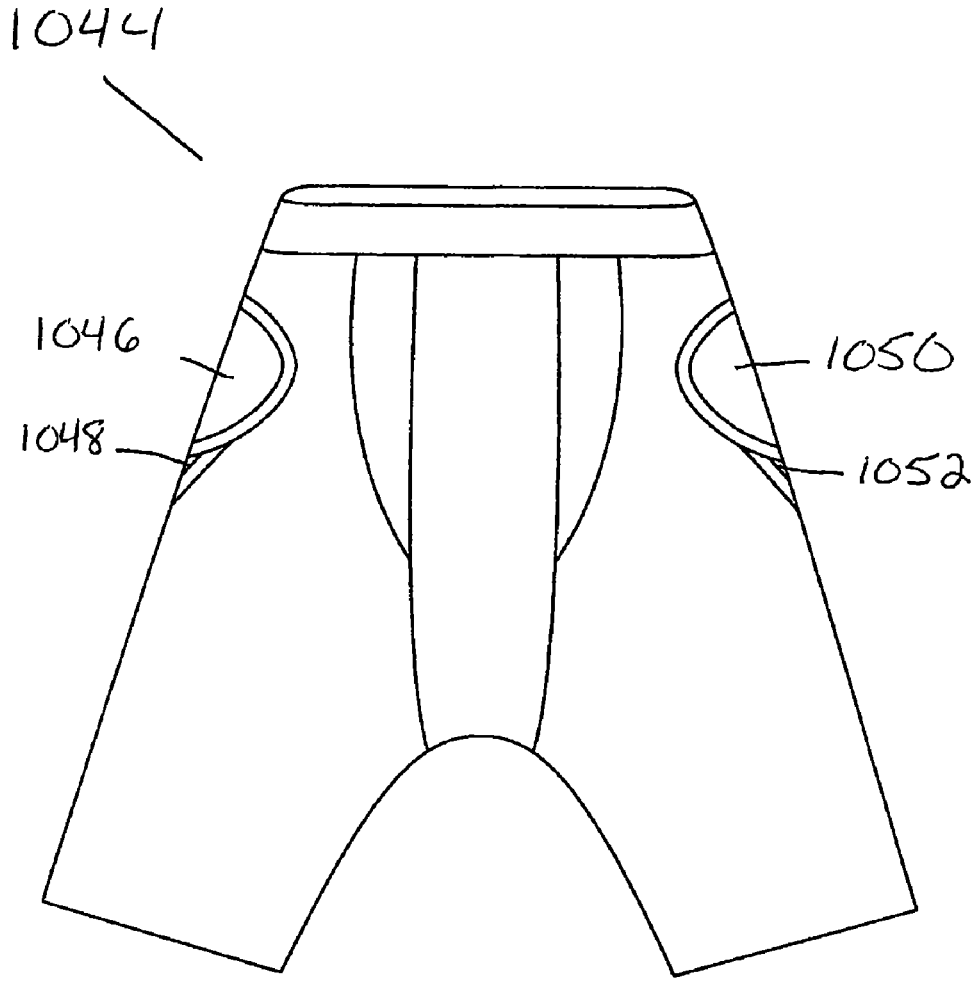
FIG. 10 is a front view of a pair of shorts having pockets for incorporating a pad.
Figure 11:
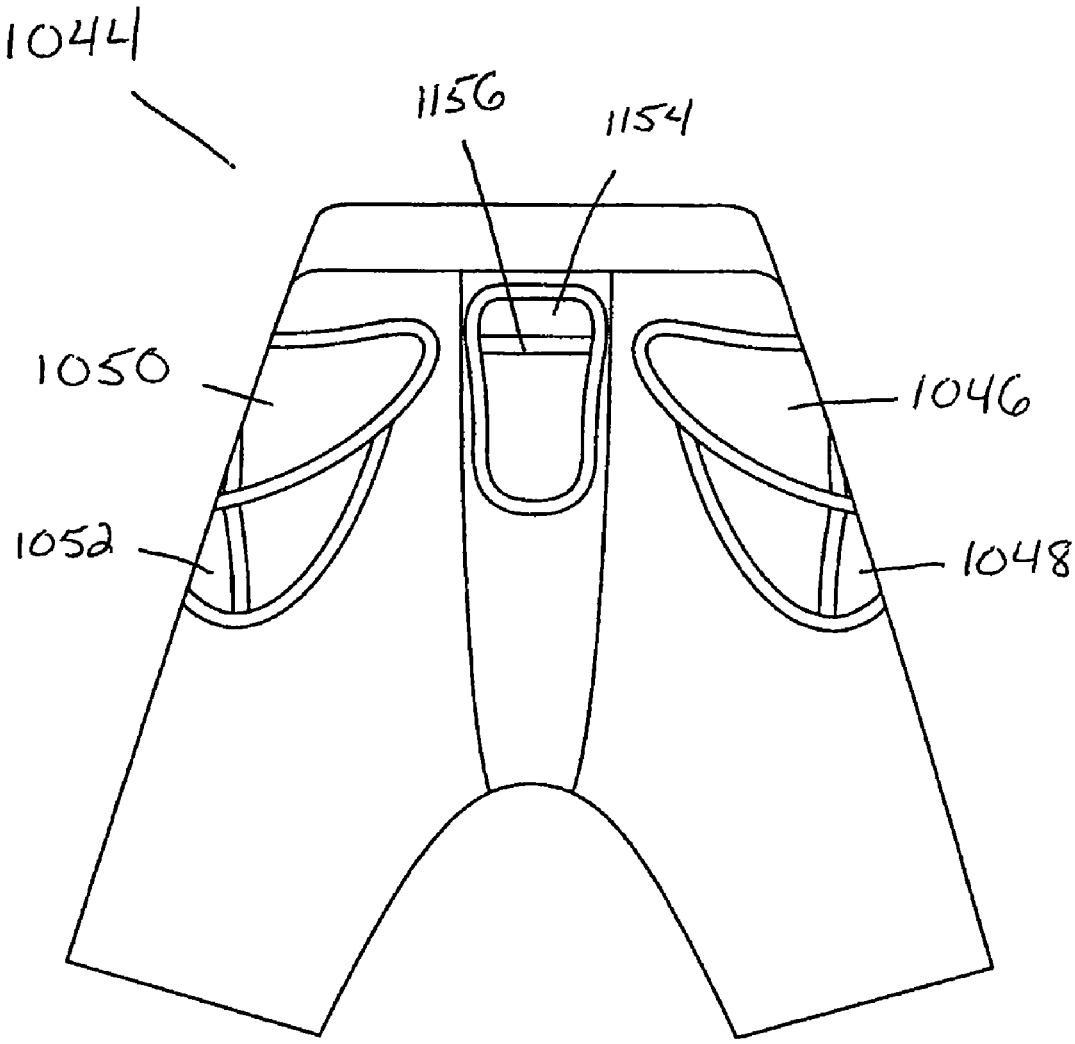
FIG. 11 is a back view of a pair of shorts having pockets for incorporating a pad.
Figure 12:
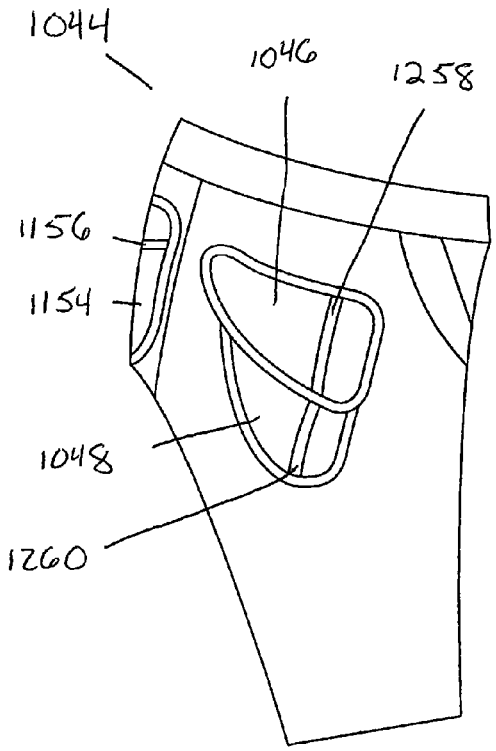
FIG. 12 is a right side view of a pair of shorts having pockets for incorporating a pad.
Figure 13:
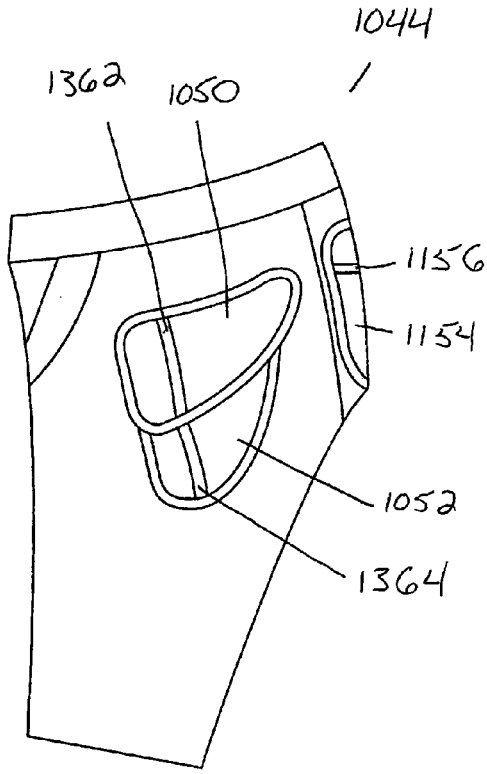
FIG. 13 is a left side view of a pair of shorts having pockets for incorporating a pad.

FIG. 8A is a representative cross-sectional view of a pocket. The pad is present in the pocket on either side of the opening. Each pocket opening has an upper layer 836 and a lower layer 838, with the upper layer 836 overlapping the lower layer 838. The upper and lower layers 836, 838 are pulled apart in order to insert and remove the pad from the pocket.

Preferably, upper right rib pocket 102 and upper left rib pocket 106 are shaped to hold a pad with the shape of pad 210. Preferably, lower right rib pocket 104, lower left rib pocket 108, right back pocket 724 and left back pocket 728 are shaped to hold a pad with the shape of pad 310.

It is noted that a sleeveless shirt with six pockets is exemplary and could contain just two pockets for the lower back, just four pockets with two each for the left and right ribs or any other number or combination of pockets as would have been apparent to one of ordinary skill in the art. It is also noted that pockets could be located at other areas of the sleeveless shirt such as at the sternum.

In addition, a sleeveless shirt is exemplary and the garment can also be a long sleeve shirt or a short sleeve shirt. Such shirts could have additional pads in other areas such as at the shoulders and elbows and could have additional pockets in such other areas for holding pads.

FIGS. 10-13 depict a second embodiment of the padded garment in the form of a pair of shorts 1044. The pair of shorts 1044 preferably has a an upper right hip pocket 1046, a lower right hip pocket 1048, an upper left hip pocket 1050, a lower left hip pocket 1052 and a coccyx pocket 1154. Each pocket has an opening, 1258, 1260, 1362, 1364 and 1156, respectively, for insertion and removal of a pad from each pocket. The upper right and lower right hip pockets 1046, 1048 are located on a right side of the pair of shorts 1044 and each contains a pad for protecting the right hip. The upper left and lower left hip pockets 1050, 1052 are located on a left side of a pair of shorts 1044 and each contains a pad for protecting the left hip. The coccyx pocket 1154 is located in a center of a back of said pair of shorts 1044 and contains a pad for protecting the coccyx.

Preferably, upper right hip pocket 1046 and upper left hip pocket 1050 are shaped to hold a pad with the shape of pad 310. Preferably, lower right hip pocket 1048 and lower left hip pocket 1052 is shaped to a hold a pad with the shape of pad 410. Preferably, coccyx pocket 1154 is shaped to hold a pad with the shape of pad 510.

It is noted that a pair of shorts with five pockets is exemplary and could contain just one pocket for the coccyx, just four pockets with two each for the left and right hips or any other number or combination of pockets as would have been apparent to one of ordinary skill in the art.

In addition, a pair of shorts is exemplary and the garment can also be a pair of pants. Such a pair of pants could have additional pads in other areas such as at the knees and shins and could have additional pockets in such other areas for holding pads.

Figure 14:
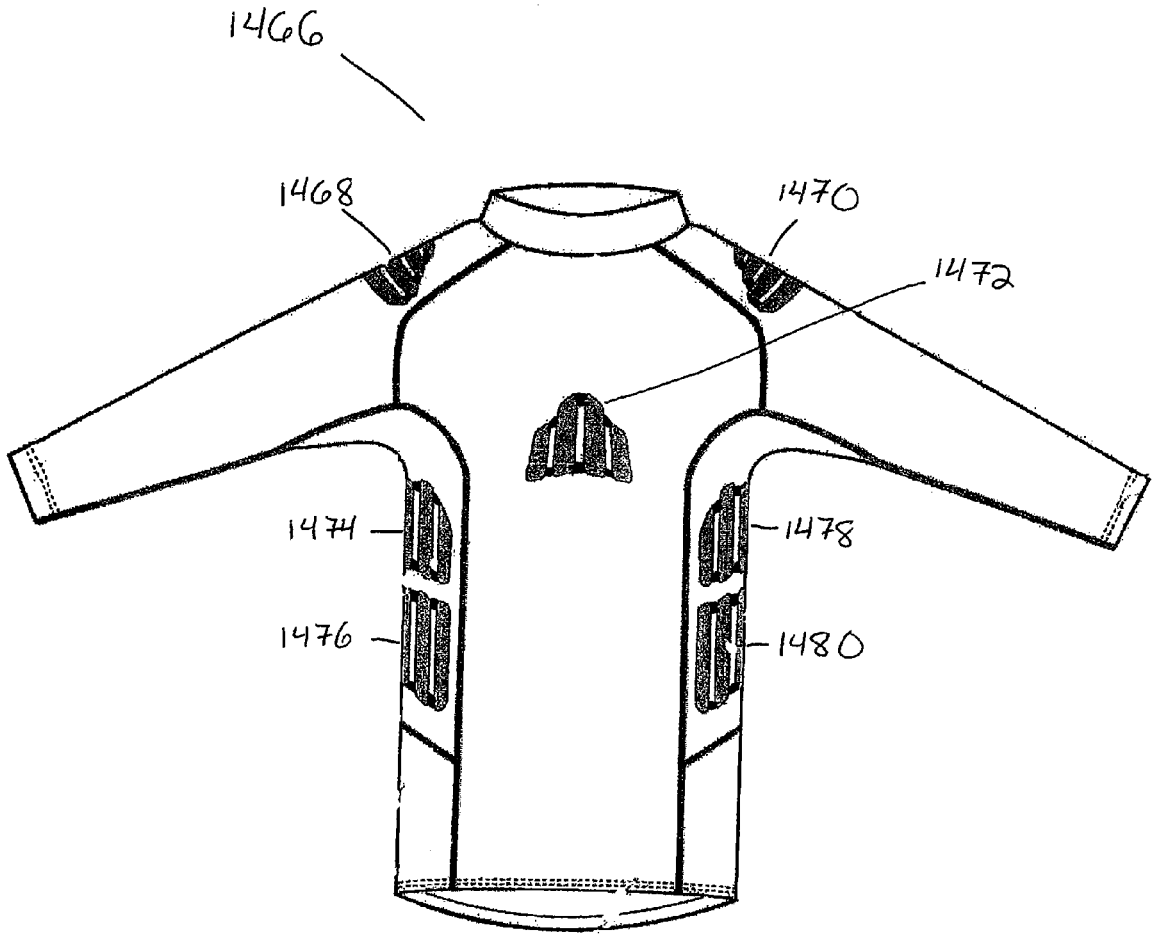
FIG. 14 is a front view of a long sleeve shirt having pads held thereto.
Figure 15:
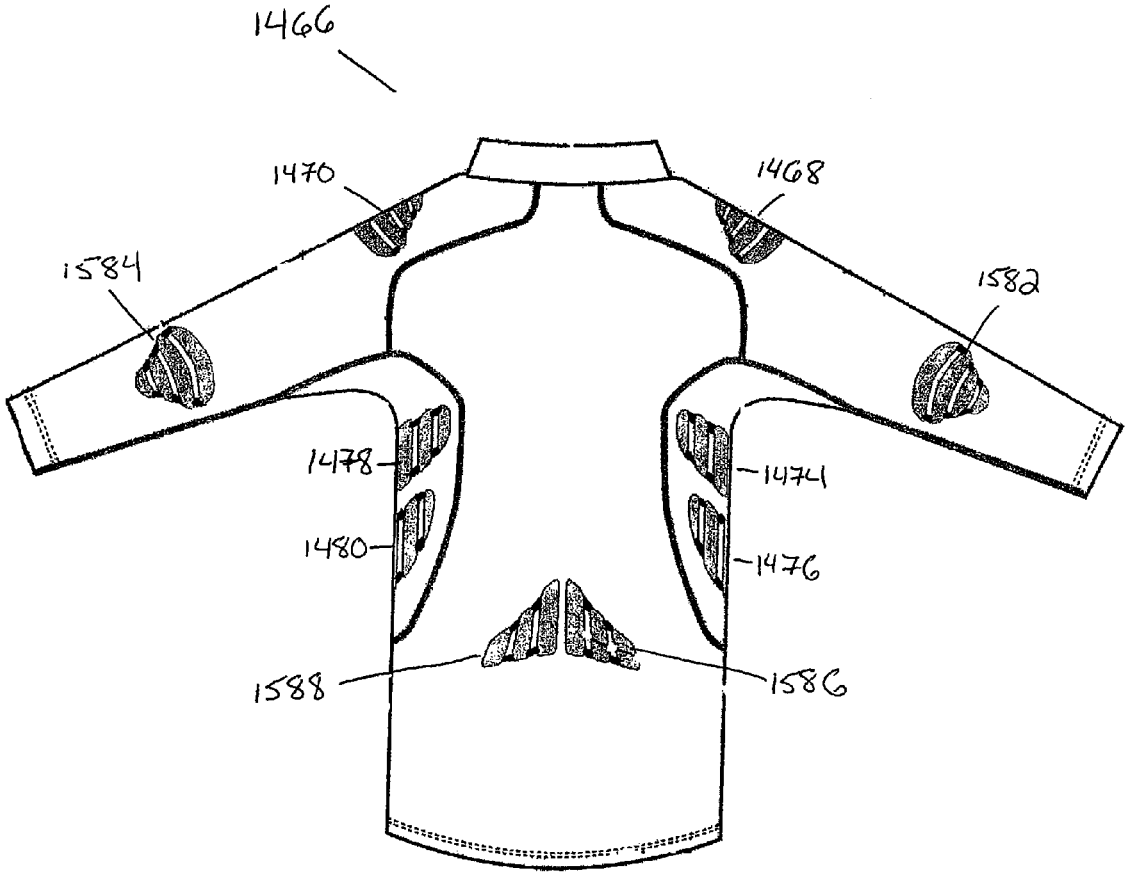
FIG. 15 is a back view of a long sleeve shirt having pads held thereto.

FIGS. 14 and 15 depict a third embodiment of the padded garment in the form of a long sleeve shirt 1466. The long sleeve shirt 1466 preferably has a right shoulder pad 1468, a left shoulder pad 1470, a sternum pad 1472, an upper right rib pad 1474, a lower right rib pad 1476, an upper left rib pad 1478 and a lower left rib pad 1480, a right elbow pad 1584, a left elbow pad 1582, a right lower back pad 1588 and a left lower back pad 1586. The right and left shoulder pads 1468, 1470 are positioned to cover the wearer's right and left shoulders, respectively. The sternum pad 1472 is positioned to cover the wearer's sternum. The upper and lower right rib pads 1474, 1476 are positioned to cover the wearer's right rib cage. Similarly, the upper and lower left rib pads 1478, 1480 are positioned to cover the wearer's left rib cage. The right and left elbow pads 1582, 1584 are positioned to cover the wearer's right and left elbows, respectively. The right and left lower back pads 1586, 1588 are positioned to cover the wearer's right and left lower rib cage, respectively.

It is noted that the long sleeve shirt 1466 illustrates pads held thereto without pockets, however any means for holding may be utilized as would be readily apparent to one of ordinary skill in the art, such as pockets, sewing or stitching, adhesive, clasps or hook and pile connectors. It is also noted that different means for holding can be utilized for holding different pads to the same garment It is also noted that an exemplary short sleeve shirt according to the present invention would have the same features as the long sleeve shirt 1466, except it would have short sleeves and no elbow pads.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

What is claimed is:

1. A garment comprising:

an article of clothing having at least one pocket, wherein said article of clothing is selected from the group consisting of a long sleeve shirt a short sleeve shirt, a sleeveless shirt, a pair of shorts and a pair of pants; and at least one pad having a top plane, said at least one pad located within said at least one pocket, wherein said at least one pad comprises:

a plurality of interconnected, spaced apart tubes, wherein each tube has a first end and a second end; and a first enclosed pathway along a first portion of a perimeter of said at least one pad interconnecting each of said first ends, wherein said first enclosed pathway is recessed from the top plane of said at least one pad between adjacent tubes and wherein said first enclosed pathway comprises at least one opening in each of said tubes adjacent said first end;

wherein adjacent tubes are spaced apart to form an aperture through said at least one pad such that said aperture is defined by at least said adjacent tubes and said first enclosed pathway.

2. The garment of claim 1, wherein said interconnected tubes form a cavity, which is filled with fluid that can flow between said plurality of spaced apart tubes.

3. The garment of claim 2, wherein said fluid is air.

4. The garment of claim 3, wherein the air in said cavity is at atmospheric pressure.

5. The garment of claim 3, wherein the air in said cavity is pressurized.

6. The garment of claim 1, wherein said at least one pad comprises ethylene-vinyl acetate (EVA).

7. The garment of claim 1, wherein said at least one pad comprises a foam.

8. The garment of claim 1, wherein said at least one pad comprises a gel.

9. The garment of claim 1, wherein said at least one pad further comprises:

a second enclosed pathway along a second portion of said perimeter of said at least one pad interconnecting each of said second ends.

10. The garment of claim 9, wherein said second pathway is recessed from the top plane of said at least one pad between adjacent tubes and wherein said aperture is also defined by said second enclosed pathway.

11. The garment of claim 10, wherein said at least one pad is flexible along said recessed areas of said first and second pathways and substantially less flexible along a length of any of said plurality of spaced apart tubes.

12. The garment of claim 10, wherein said second pathway is recessed from a bottom plane of said at least one pad between adjacent tubes.

13. The garment of claim 1, wherein said at least one pad is flexible such that it conforms to an area of a wearer's body that said at least one pad covers.

14. The garment of claim 1, wherein said at least one pad is shaped to correspond to an area of a wearer's body that said at least one pad covers.

15. The garment of claim 1, wherein said at least one pad is removable from said at least one pocket.

16. The garment of claim 1, wherein said at least one pocket has a first end and a second end and an opening intermediate the first and second ends of the pocket.

17. The garment of claim 1, wherein said at least one pad covers an area selected from the group consisting of ribs, lower back, shoulders, elbows, knees, hips, coccyx, shins and sternum.

18. The garment of claim 1, wherein said at least one pad has a bottom plane, wherein said first pathway is recessed from the bottom plane of said at least one pad between adjacent tubes.

19. A garment comprising:

an article of clothing; and at least one pad having a top plane, said at least one pad held to said article of clothing, wherein said at least one pad comprises:

a plurality of interconnected, spaced apart tubes, wherein each tube has a first end and a second end;

a first enclosed pathway along a first portion of a perimeter of said at least one pad interconnecting each of said first ends, wherein said first enclosed pathway is recessed from the top plane of said at least one pad between adjacent tubes and wherein said first enclosed pathway comprises at least one opening in each of said tubes adjacent said first end; and a second enclosed pathway along a second portion of said perimeter of said at least one pad interconnecting each of said second ends, wherein said second pathway is recessed from the to lane of said at least one sad between adjacent tubes;

wherein adjacent tubes are spaced apart to form an aperture through said at least one pad such that said aperture is defined by at least said adjacent tubes, said first enclosed pathway, and said second enclosed pathway.

20. The garment of claim 19, wherein said at least one pad is flexible along said recessed areas of said first and second pathways and substantially less flexible along a length of any of said plurality of spaced apart tubes.

21. The garment of claim 19, wherein said at least one pad is removable from said article of clothing.

22. The garment of claim 19, wherein said at least one pad has a bottom plane, wherein said first pathway is recessed from the bottom plane of said at least one pad between adjacent tubes.

23. The garment of claim 19, wherein said second pathway is recessed from a bottom plane of said at least one pad between adjacent tubes.

24. A garment comprising:

an article of clothing having at least one pocket; and at least one pad having a top plane, said at least one pad located within said at least one pocket, wherein said at least one pad comprises:

a plurality of interconnected, spaced apart tubes, wherein each tube has a first end and a second end;

a first enclosed pathway along a first portion of a perimeter of said at least one pad interconnecting each of said first ends, wherein said first enclosed pathway is recessed from the top plane of said at least one pad between adjacent tubes and wherein said first enclosed pathway comprises at least one opening in each of said tubes adjacent said first end; and a second enclosed pathway along a second portion of said perimeter of said at least one pad interconnecting each of said second ends, wherein said second pathway is recessed from the top plane of said at least one pad between adjacent tubes;

wherein adjacent tubes are spaced apart to form an aperture through said at least one pad such that said aperture is defined by at least said adjacent tubes, said first enclosed pathway, and said second enclosed pathway.

* * * * *